US007584958B2

(12) United States Patent
Ficarra et al.

(10) Patent No.: US 7,584,958 B2
(45) Date of Patent: Sep. 8, 2009

(54) DOCUMENT STACK LEVELING METHOD, AND A DOCUMENT FINISHER INCLUDING THE SAME

(75) Inventors: Richard P Ficarra, Ontario, NY (US); Carlos M Terrero, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 202 days.

(21) Appl. No.: 11/770,075

(22) Filed: Jun. 28, 2007

(65) Prior Publication Data

US 2009/0001658 A1 Jan. 1, 2009

(51) Int. Cl.
*B65H 31/04* (2006.01)

(52) U.S. Cl. ..... 271/213; 271/217

(58) Field of Classification Search ..... 271/2, 271/213, 214, 217, 218; 270/58.13, 58.19
See application file for complete search history.

(56) References Cited

U.S. PATENT DOCUMENTS 1,863,465 A * 6/1932 Borrowdale ..... 271/217
4,605,211 A * 8/1986 Sonobe ..... 270/58.17
5,332,210 A * 7/1994 Silverberg et al. ..... 271/220
5,350,169 A * 9/1994 Hiroi et al. ..... 271/213
6,260,843 B1 * 7/2001 Hoshimura et al. ..... 271/213
6,695,304 B1 * 2/2004 Werner ..... 271/146
6,699,005 B2 * 3/2004 Askins ..... 414/788.3

* cited by examiner

*Primary Examiner*—Kaitlin S Joerger
(74) *Attorney, Agent, or Firm*—Gibb I.P. Law Firm, LLC

(57) ABSTRACT

A document finisher is arranged for forming a document stack whose top surface is maintained substantially level. The document finisher includes a document stack leveling container for containing a document stack of one or more documents. Each document has a document thick side that is thicker than the opposite document thin side. The document stack leveling container includes a hollow. The document finisher is arranged for disposing documents in the hollow, thus forming a document stack therein. The hollow includes a bottom shaped such that the document stack top surface is maintained substantially level.

26 Claims, 4 Drawing Sheets

DOCUMENT STACK LEVELING METHOD, AND A DOCUMENT FINISHER INCLUDING THE SAME

BACKGROUND OF THE INVENTION

Document finisher modules are known. Xerox has launched the Base Finisher Module, a finishing device with stacking (with and without offsetting), stapling (portrait, landscape and dual), and dual finishing (unload while run) capabilities. As depicted in FIG. 1, the architecture consists of an input transport 10, compiler 50 and a stack tray 60 with a full capacity of 3,000 sheets. This capacity decreases as stack flatness deteriorates due to any of paper curl, waviness and staple thickness. The uneven stack growth caused by staple thickness creates the following problem and the need for this invention.

First, as to stack quality and productivity, the stack flatness rapidly deteriorates due to the cumulative effect of the staple thickness, significantly reducing the number of sheets and sets that can be stacked reliably. Currently small stapled sheets comprising 15 sheets or less are limited to low number of sets to minimize shutdowns.

Second, as to handling, the stack of stapled sets is unstable, making it very difficult to handle, store and package.

Thus, there is a need for the present invention.

BRIEF SUMMARY OF THE INVENTION

In a first aspect of the invention, there is provided a method for leveling a document stack comprising (a) providing a document stack leveling container for leveling a stack of one or more documents, each document having a document thick side that is thicker than the opposite document thin side, the document stack leveling container having generally-upright container sides defining an upper container mouth and an opposite container bottom, the document stack leveling container mouth and sides forming a container hollow, a document stack top surface leveling ramp disposed in the document stack leveling container hollow so an included ramp surface slopes downward from an included container shallow end towards the opposite included container deep end; and (b) disposing documents in the document stack leveling container to form a document stack therein with the included document thick sides generally proximate to the document stack leveling container deep end.

In a second aspect of the invention, there is provided a document finisher arranged for leveling a document stack in accordance with a method, the method comprising (a) providing a document stack leveling container for leveling a stack of one or more documents, each document having a document thick side that is thicker than the opposite document thin side, the document stack leveling container having generally-upright container sides defining an upper container mouth and an opposite container bottom, the document stack leveling container mouth and sides forming a container hollow, a document stack top surface leveling ramp disposed in the document stack leveling container hollow so an included ramp surface slopes downward from an included container shallow end towards the opposite included container deep end; and (b) arranging the document finisher to dispose documents in the document stack leveling container to form a document stack therein with the included document thick sides generally proximate to the document stack leveling container deep end.

In a third aspect of the invention, there is provided a method for leveling a document stack comprising (a) providing a container means for leveling a document stack of one or more documents, each document having a document thick side that is thicker than the opposite document thin side; and (b) disposing documents in the container means, thus forming a document stack therein; where the container means includes a bottom surface arranged such that an included document stack top surface is maintained substantially level.

In a fourth aspect of the invention, there is provided a document finisher arranged for leveling a document stack comprising container means for leveling a document stack of one or more documents, each document having a document thick side that is thicker than the opposite document thin side; and means for disposing documents in the container means, thus forming a document stack therein; where the container means includes a bottom surface arranged such that an included document stack top surface is maintained substantially level.

DETAILED DESCRIPTION OF THE INVENTION

Briefly, in accordance with the present invention, a document finisher is arranged for forming a document stack whose top surface is maintained substantially level. The document finisher includes a document stack leveling container for containing a document stack of one or more documents. Each document has a document thick side that is thicker than the opposite document thin side. The document stack leveling container includes a hollow. The document finisher is arranged for disposing documents in the hollow, thus forming a document stack therein. The hollow includes a bottom shaped such that the document stack top surface is maintained substantially level.

Figure 4:
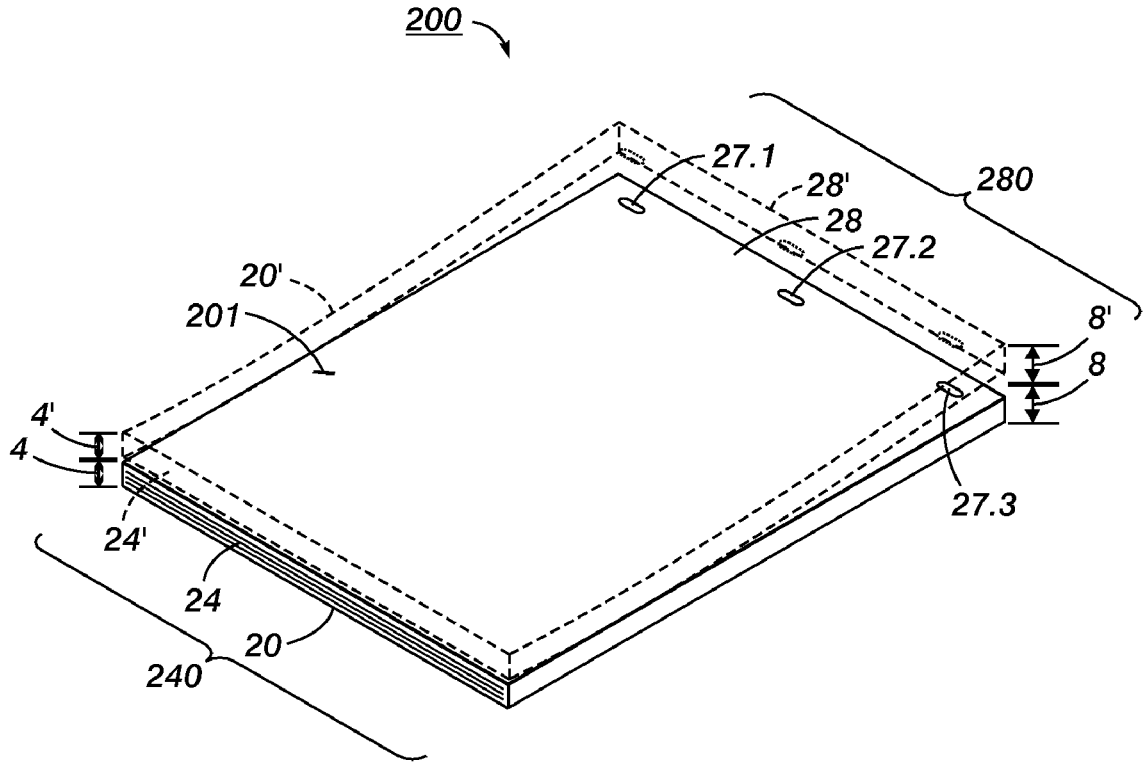
FIG. 4 depicts a document stack 200, including a depicted document stack top surface 201.

Referring to FIG. 4 the depicted document stack 200 comprises one or more documents 20, 20'. Each document 20, 20' includes a document thick side 28, 28' that is thicker than the corresponding opposite document thin side 24, 24'. Thus, the depicted document thick side 28, 28' has a corresponding thickness 8, 8' and the depicted opposite document thin side 24, 24' has a corresponding thickness 4, 4', where the document thick side 28, 28' thickness 8, 8' is greater than the document thin side 24, 24' thickness 4, 4'. In one embodiment, the documents 20, 20' comprise media sheets that are fastened near the document thick side 28, 28'. In FIG. 4 suitable document fasteners are depicted by reference numbers 27.1, 27.2 and 27.3. In one embodiment, the document thick side 28, 28' thickness 8, 8' is based on the presence of one or more document fasteners 27.1, 27.2 and 27.3. In one embodiment, the media sheets are fastened with staples, thus forming stapled media sets.

Figure 1:
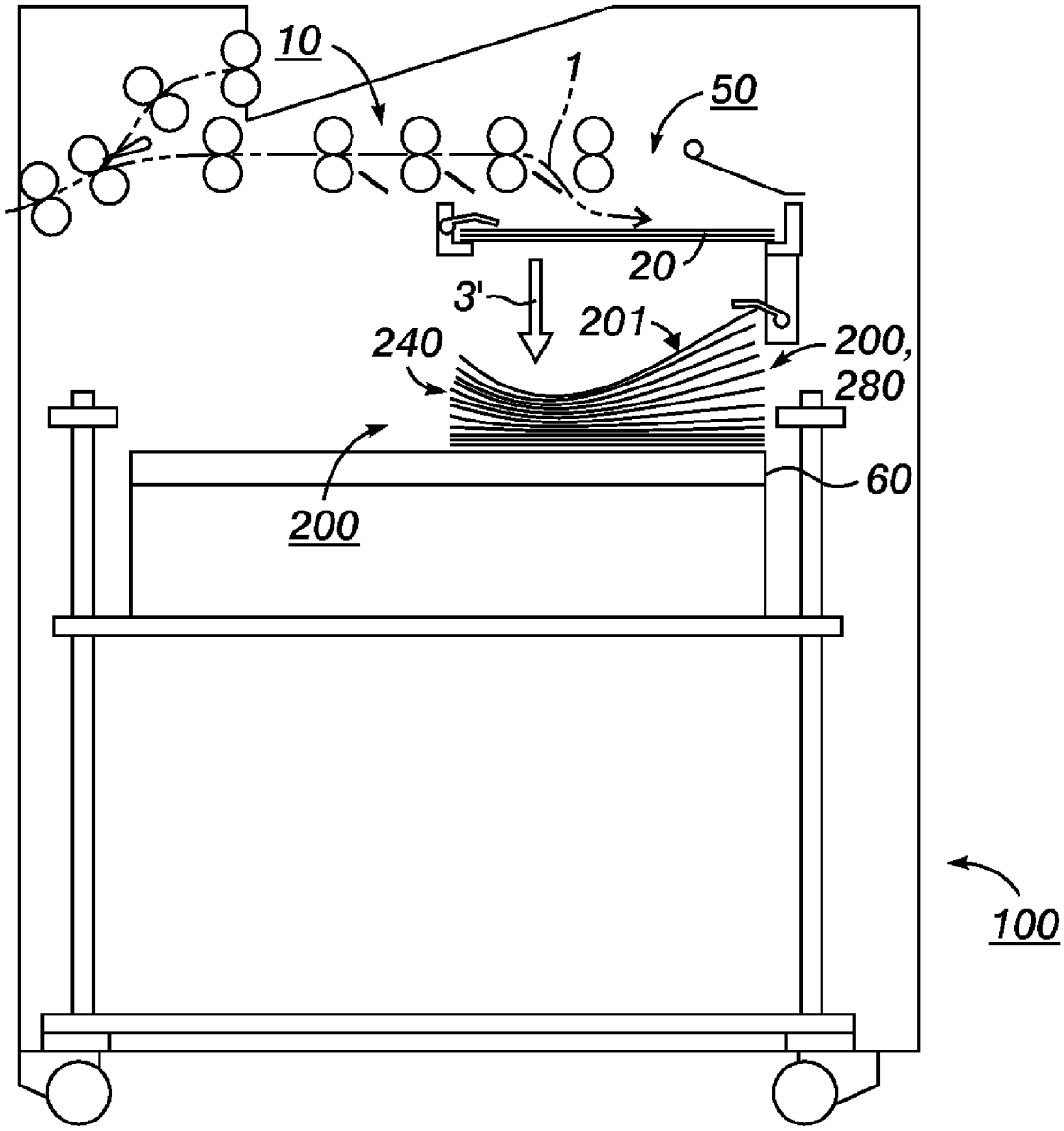
FIG. 1 PRIOR ART
FIG. 1 depicts a document finisher module 100 in accordance with the prior art wherein the depicted document stack top surface 201 is NOT maintained substantially horizontal and level.

Referring to FIG. 1 during compiling the sheets 20 enter the compiler area 50 via the input transport 10. After the full set is compiled it is dropped 3' on the document stack 200 below. The maximum capacity of the document finisher module 100 is 3000 sheets.

As depicted in FIG. 1, for stapled sets a build-up of staples causes the document stack 200 to grow uneven and very unstable. Currently the stack height is limited for stapled sets with the worst-case being small sets, 15 sheets or less.

Figure 2:
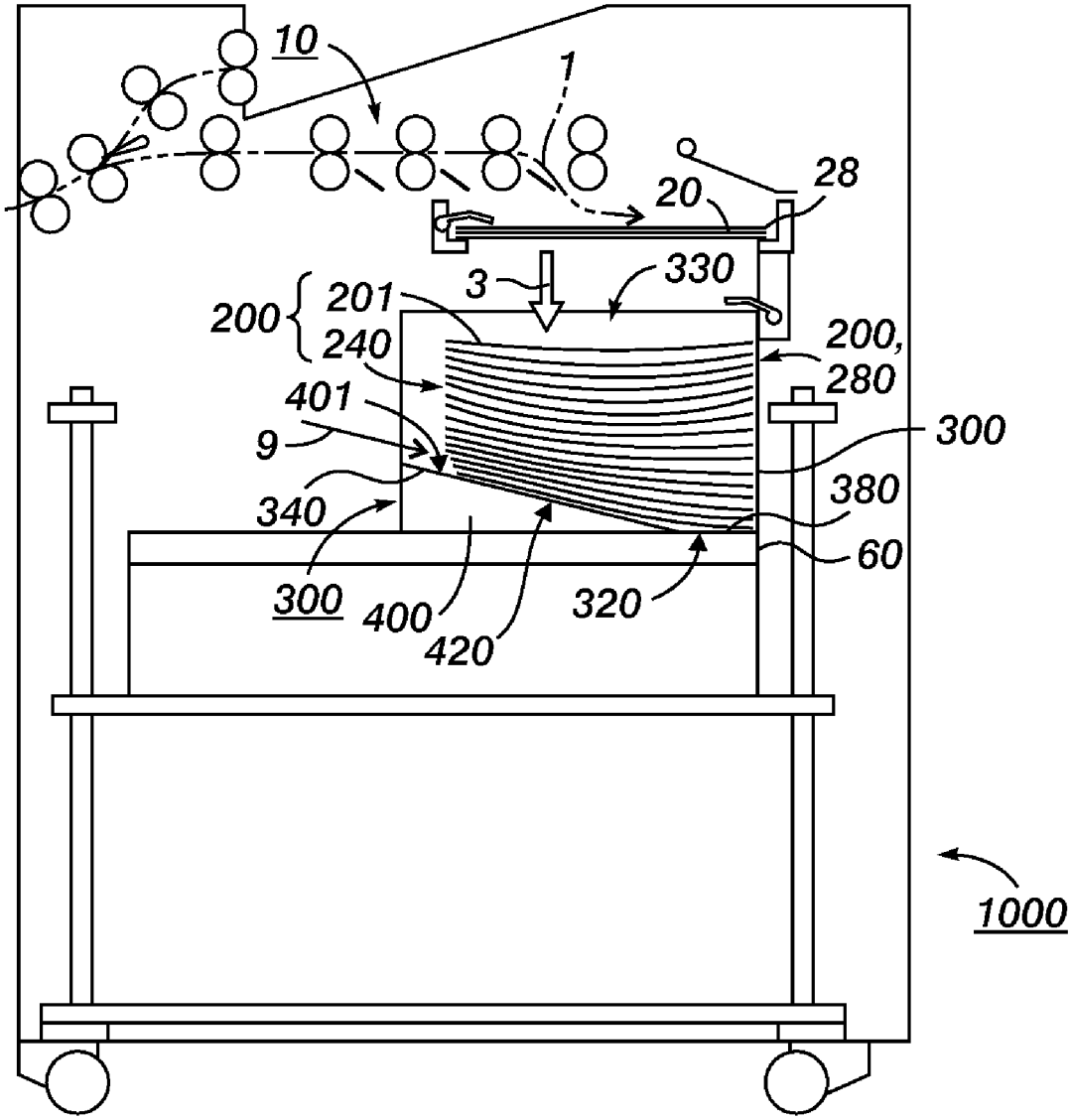
FIG. 2 depicts a document finisher module 1000 arranged with a document stack leveling container 300. In accordance with the present invention, the depicted document stack stop surface 201 is maintained substantially horizontal and level.

Referring to FIG. 2, the document stack leveling container 300 provides the necessary structure to allow the growth of the stapled set document stack 200. In addition, the container 300 facilitates the handling of unstable stacks and may be used as a storage and shipping container.

Figure 3:
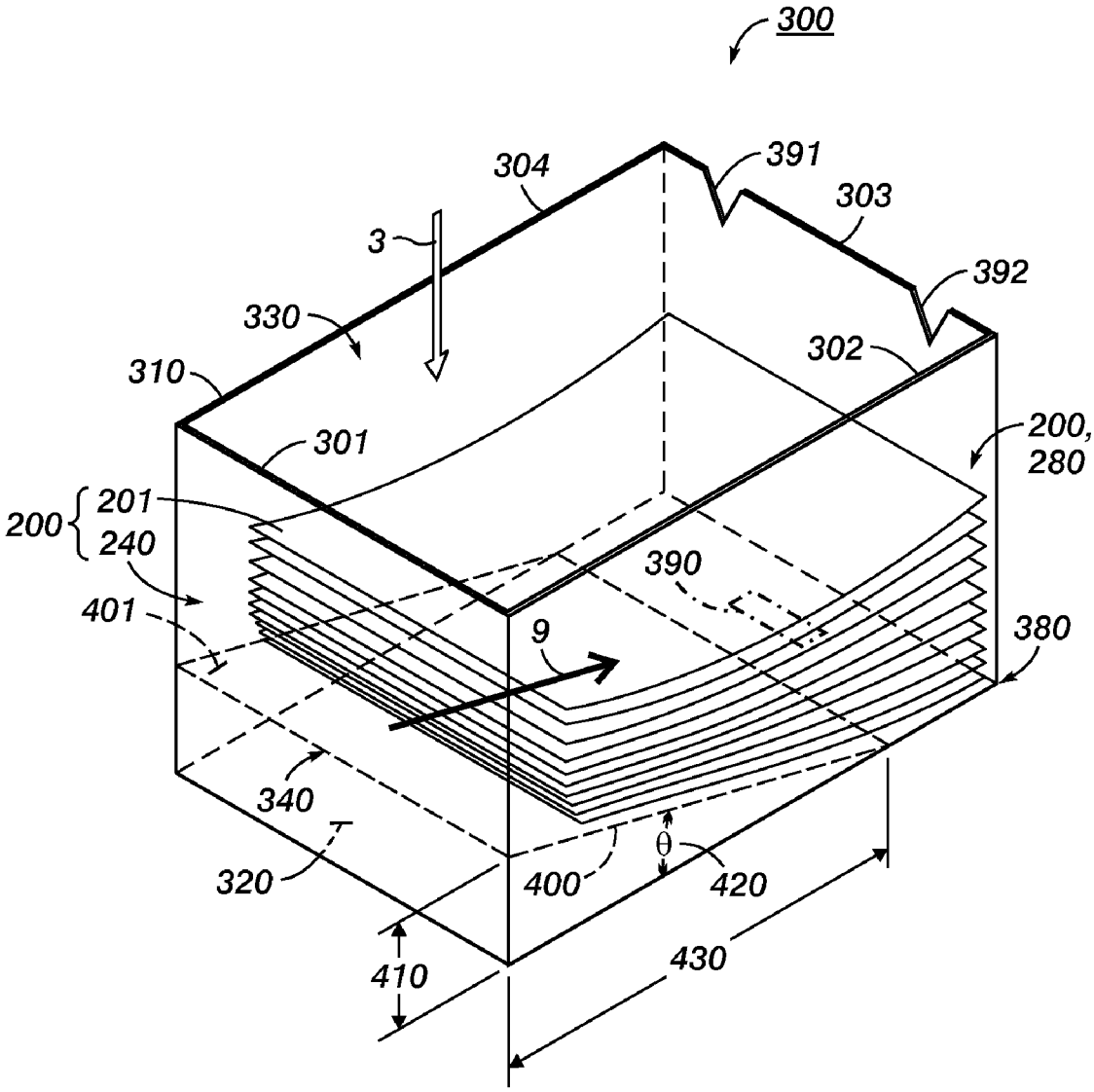
FIG. 3 depicts the document stack leveling container 300 of FIG. 2.

Referring to FIG. 3 there is depicted a document stack leveling container 300 wherein stapled sets may be stacked, stored and delivered. In various embodiments, the document stack leveling container contains a depicted sensor cutout 390 and depicted one or more clamp open notches 391, 392, which set tray height. These optional features 390, 391, 392 enable the document stack leveling container 300 to interact with sensors and mechanisms within the FIG. 2 finisher 1000 as it facilitates the required structure for stack growth. In addition the document stack leveling container 300 may serve as a ready-to-use storage carton, shipping carton, or both. A key benefit is there are no new sensors, electronics or software required to operate with the document stack leveling container.

As shown, the document stack leveling container 300 comprises generally-upright container sides 301, 302, 303, 304 defining an upper container mouth 310 and an opposite container bottom 320. The container mouth 310 and sides 301-304 form a container hollow 330. As shown, a document stack top surface leveling ramp 400 is disposed in the document stack leveling container hollow 330 so that an included ramp surface 401 slopes downward from an included container shallow end 340 towards the opposite included container deep end 380. As shown, the ramp 400 comprises a ramp height 410 and a ramp bottom 430 sized such that the document stack top surface 201 depicted in FIG. 2 is maintained substantially level. In one embodiment, the ramp surface 401 is inclined at an angle 420 so that each document 20 flows 9 down the ramp towards the container deep end 380.

Referring now generally to FIGS. 2-3, there is provided the first aspect of the invention, namely, a method for leveling a document stack 200.

Thus, in accordance with the first aspect, the document stack 200 is leveled by providing a document stack leveling container 300 for leveling a stack 200 of one or more documents 20, 20'; and disposing 3 documents 20, 20' in the document stack leveling container 300 to form a document stack 200 therein with the included document thick sides 28, 28' generally proximate to the document stack leveling container deep end 380. As a result, the document stack top surface 201 is maintained substantially level.

In one embodiment, the above method includes providing a document finisher 1000 and arranging the document finisher for disposing the documents 20, 20' in the document stack leveling container 300.

In one embodiment, the document stack leveling container 300 is detachable from the document finisher 1000.

In one embodiment, the document stack leveling container 300 comprises any of a storage carton and a shipping carton.

In one embodiment, the method includes providing a sensor cutout 390 in the document stack leveling container 300 bottom 320 near the document stack leveling container deep end 380.

In one embodiment, the document stack leveling container 300 is comprised of cardboard.

In one embodiment, the method includes providing one or more clamp open notches 391, 392 in the mouth 310 proximate to the document stack leveling container deep end 380.

Still referring generally to FIGS. 2-3, there is provided the second aspect of the invention, namely, a document finisher 1000 arranged for leveling a document stack 200 in accordance with a method.

Thus, in accordance with the second aspect, the method comprises providing a document stack leveling container 300 for leveling a stack 200 of one or more documents 20, 20'; and arranging the document finisher 1000 to dispose 3 documents 20, 20' in the document stack leveling container 300 to form a document stack 200 therein with the included document thick sides 28, 28' generally proximate to the document stack leveling container deep end 380. As a result, the document stack top surface 201 is maintained substantially level.

Referring still generally to FIGS. 2-3, there is provided the third aspect of the invention, namely, a method for leveling a document stack 200.

Thus, in accordance with the third aspect, the method comprises providing a container means 300 for leveling a document stack 200 of one or more documents 20, 20'; and disposing 3 documents in the container means, thus forming a document stack 200 therein; where the container means includes a bottom surface 401 arranged such that an included document stack top surface 201 is maintained substantially level.

In one embodiment, the above method includes providing a document finisher 1000 and arranging the document finisher for disposing the documents in the container means 300. In one variation of this embodiment, the container means 300 is detachable from the document finisher 1000.

Still referring generally to FIGS. 2-3, there is provided the fourth aspect of the invention, namely, a document finisher 1000 arranged for leveling a document stack.

Thus, in accordance with the fourth aspect, the document finisher 1000 comprises container means 300 for leveling a document stack 200; and means for disposing 3 documents in the container means, thus forming a document stack 200 therein; where the container means includes a bottom surface 401 arranged such that an included document stack top surface 201 is maintained substantially level.

In one embodiment, the container means 300 is detachable from the document finisher 1000.

In summary, there is provided a document stack leveling container wherein stapled sets are stacked by a printer or copier. The document stack leveling container is placed on the output tray. The document stack leveling container includes a sloped bottom to accommodate stable build up on one edge or corner, and has cutout features that enable it to interact with sensors and mechanisms in the finisher to monitor tray position and stack height. Using the document stack leveling container, up to about 2000 sheets can be stacked, whereas without the document stack leveling container the limit is about 200 for 2-sheet sets, the worst case. The document stack leveling container is feasible to manufacture from cardboard.

The table below lists the drawing element reference numbers together with their corresponding written description:

| No.: | Description: |
|---|---|
| 1 | document travel path |
| 3 | disposing document |
| 3' | disposing document |
| 4 | document thin side thickness |

-continued

| No.: | Description: |
|---|---|
| 4' | document thin side thickness |
| 8 | document thick side thickness |
| 8' | document thick side thickness |
| 9 | document flow |
| 10 | input transport |
| 20 | document |
| 20' | document |
| 24 | document thin side |
| 27.1 | document fastener |
| 27.2 | document fastener |
| 27.3 | document fastener |
| 28 | document thick side |
| 50 | compiler |
| 60 | stack tray |
| 100 | document finisher module |
| 200 | document stack |
| 201 | document stack top surface |
| 240 | document stack thin side |
| 280 | document stack thick side |
| 300 | document stack leveling container |
| 301-304 | document stack leveling container sides |
| 310 | document stack leveling container mouth |
| 320 | document stack leveling container bottom |
| 330 | document stack leveling container hollow |
| 340 | document stack leveling container shallow end |
| 380 | document stack leveling container deep end |
| 390 | sensor cutout |
| 391, 392 | clamp open notches |
| 400 | ramp |
| 401 | ramp surface |
| 410 | ramp height |
| 420 | ramp angle |
| 430 | ramp bottom length |
| 1000 | document finisher module |

While particular embodiments have been described hereinabove, alternatives, modifications, variations, improvements and substantial equivalents that are or may be presently unforeseen may arise to applicants or others skilled in the art. Accordingly, the appended claims as filed and as they may be amended are intended to embrace all such alternatives, modifications, variations, improvements and substantial equivalents.

What is claimed is:

1. A method for leveling a document stack comprising:

(a) providing a document stack leveling container for leveling a stack of one or more documents, each document having a document thick side that is thicker than the opposite document thin side, the document stack leveling container having generally-upright container sides defining an upper container mouth and an opposite container bottom, the document stack leveling container mouth and sides forming a container hollow, a document stack top surface leveling ramp disposed in the document stack leveling container hollow so an included ramp surface slopes downward from an included container shallow end towards the opposite included container deep end; and (b) disposing documents in the document stack leveling container to form a document stack therein with the included document thick sides generally proximate to the document stack leveling container deep end; and including providing a sensor cutout in the document stack leveling container bottom near the document stack leveling container deep end.

2. The method of claim 1 including inclining the ramp surface so that each document flows down the ramp towards the document stack leveling container deep end.

3. The method of claim 1 where the ramp comprises a ramp height and a ramp bottom sized such that an included document stack top surface is maintained substantially level.

4. The method of claim 1 where the documents comprise media sheets that are fastened near the document thick side.

5. The method of claim 4 where the media sheets are fastened with staples, thus forming stapled media sets.

6. The method of claim 1 including providing a document finisher and arranging the document finisher for disposing the documents in the document stack leveling container.

7. The method of claim 6 where the document stack leveling container is detachable from the document finisher.

8. The method of claim 7 where the document stack leveling container comprises any of a storage carton and a shipping carton.

9. The method of claim 1 including providing one or more clamp open notches in the mouth proximate to the document stack leveling container deep end.

10. A document finisher arranged for leveling a document stack comprising:

(a) a document stack leveling container for leveling a stack of one or more documents, each document having a document thick side that is thicker than the opposite document thin side, the document stack leveling container having generally-upright container sides defining an upper container mouth and an opposite container bottom, the document stack leveling container mouth and sides forming a container hollow, a document stack top surface leveling ramp disposed in the document stack leveling container hollow so an included ramp surface slopes downward from an included container shallow end towards the opposite included container deep end; and (b) a document transport that disposes documents in the document stack leveling container to form a document stack therein with the included document thick sides generally proximate to the document stack leveling container deep end; and including providing a sensor cutout in the document stack leveling container bottom near the document stack leveling container deep end.

11. The document finisher of claim 10 where the ramp surface is inclined so that each document flows down the ramp towards the document stack leveling container deep end.

12. The document finisher of claim 10 where the ramp comprises a ramp height and a ramp bottom sized such that an included document stack top surface is maintained substantially level.

13. The document finisher of claim 10 where the documents comprise media sheets that are fastened near the document thick side.

14. The document finisher of claim 13 where the media sheets are fastened with staples, thus forming stapled media sets.

15. The document finisher of claim 10 where the document stack leveling container is detachable from the document finisher.

16. The document finisher of claim 15 where the document stack leveling container comprises any of a storage carton and a shipping carton.

17. The document finisher of claim 10 including providing one or more clamp open notches in the mouth proximate to the document stack leveling container deep end.

18. A method for leveling a document stack comprising:

(a) providing a container means for leveling a document stack of one or more documents, each document having a document thick side that is thicker than the opposite document thin side; and (b) disposing documents in the container means, thus forming a document stack therein;

where the container means includes a bottom surface arranged such that an included document stack top surface is maintained substantially level; and including providing one or more clamp open notches in the mouth proximate to the document stack leveling container deep end.

19. The method of claim 18 where the documents comprise media sheets that are fastened near the document thick side.

20. The method of claim 19 where the media sheets are fastened with staples, thus forming stapled media sets.

21. The method of claim 20 including providing a document finisher and arranging the document finisher for disposing the documents in the container means.

22. The method of claim 21 where the container means is detachable from the document finisher.

23. A document finisher arranged for leveling a document stack comprising:

container means for leveling a document stack of one or more documents, each document having a document thick side that is thicker than the opposite document thin side; and means for disposing documents in the container means, thus forming a document stack therein;

where the container means includes a bottom surface arranged such that an included document stack top surface is maintained substantially level; and including providing a sensor cutout in the document stack leveling container bottom near the document stack leveling container deep end.

24. The method of claim 23 where the documents comprise media sheets that are fastened near the document thick side.

25. The method of claim 24 where the media sheets are fastened with staples, thus forming stapled media sets.

26. The method of claim 25 where the container means is detachable from the document finisher.

* * * * *